US006126211A

United States Patent [19]

Dominquez

[11] Patent Number: 6,126,211

[45] Date of Patent: Oct. 3, 2000

[54] SLIDABLE DEADBOLT SECURITY DEVICE FOR SLIDING DOORS AND WINDOWS ENABLING SELECTIVE LOCKING THEREOF IN CLOSED OR PARTIALLY OPEN POSITION

[76] Inventor: Edward Dominquez, 503 Park Ave., San Jose, Calif. 95110

[21] Appl. No.: 09/164,980

[22] Filed: Oct. 1, 1998

[51] Int. Cl.[7] ..... E05C 1/12

[52] U.S. Cl. ..... 292/174; 292/175; 292/DIG. 46

[58] Field of Search ..... 292/174, 175, 292/145, 42, DIG. 46; 70/93, 98–100

[56] References Cited

U.S. PATENT DOCUMENTS

| | | | |
|---|---|---|---|
| 1,516,995 | 11/1924 | Trigueiro | 292/175 |
| 1,903,782 | 4/1933 | Eyring | 292/175 X |
| 2,699,204 | 1/1955 | Davis | 292/145 X |
| 3,085,300 | 4/1963 | Carlston | 292/DIG. 46 X |
| 3,490,802 | 1/1970 | Zeit | 292/145 |
| 3,709,539 | 1/1973 | Sodenkamp, Jr. | 292/145 |
| 3,768,847 | 10/1973 | Buck, Jr. et al. | 292/179 |
| 3,779,588 | 12/1973 | Raymon | 292/57 |
| 3,956,911 | 5/1976 | Corboud | 70/100 |
| 4,066,284 | 1/1978 | Ikemura | 292/62 |
| 4,073,517 | 2/1978 | Bills | 292/60 |
| 4,514,996 | 5/1985 | Sjogren | 70/100 |
| 4,635,976 | 1/1987 | Sigler | 292/57 |
| 4,639,022 | 1/1987 | Dunphy et al. | 292/150 |
| 4,699,406 | 10/1987 | Swanson, Jr. | 292/175 |
| 5,356,185 | 10/1994 | Cameron | 292/149 |

*Primary Examiner*—B. Dayoan
*Assistant Examiner*—Clifford B Vaterlaus
*Attorney, Agent, or Firm*—John J. Leavitt

[57] ABSTRACT

Presented is a slidable deadbolt security device designed for installation with a sliding glass door or sliding glass window. The slidable deadbolt security device is fastened to the threshold in association with the leading edge of the fixed door portion of a slidable door assembly. A deadbolt is manipulable to engage or disengage the sliding door portion. The relationship of the slidable deadbolt and the sliding door frame is such that the deadbolt cannot be disengaged from the sliding door frame unless the sliding door is completely closed. In an aspect of the invention relating to sliding glass windows, the slidable deadbolt is slidably mounted on the windowsill adjacent the leading edge of the fixed window portion of the window assembly and spaced laterally from the fixed window frame to enable the slidable window portion to move therebetween. An aperture in the frame of the sliding glass window, or in a flanged bracket attached to the trailing edge of the sliding glass window portion, receives the deadbolt, permitting the window to be partially opened a predetermined amount, but prevents further opening, prevents manipulation of the deadbolt to release its engagement with the window frame or flange, and prevents lifting of the slidable window from its track.

19 Claims, 6 Drawing Sheets

SLIDABLE DEADBOLT SECURITY DEVICE FOR SLIDING DOORS AND WINDOWS ENABLING SELECTIVE LOCKING THEREOF IN CLOSED OR PARTIALLY OPEN POSITION

BACKGROUND OF THE INVENTION

1. Field of the Invention

This invention relates to security devices of the type applicable to sliding doors and windows in residences and commercial buildings, and particularly to slidable deadbolt security devices for sliding door assemblies and sliding glass window assemblies; and to a slidable deadbolt security device enabling selective securement of a sliding door or window assembly in a partially open position.

2. Description of the Prior Art

A preliminary patentability and novelty search in connection with this invention has revealed the existence of the following United States patents:

| | | |
|---|---|---|
| 790,490 | 3,124,380 | 3,779,588 |
| 4,073,517 | 4,268,074 | 4,514,996 |
| 4,699,406 | 4,861,079 | 4,907,832 |

In recent years, great emphasis has been placed on security in one's home. Motion sensors that energize outdoor and indoor lighting, and that even emit an audible signal, have proliferated. Since locks of conventional design can be "picked", some entry doors are devoid of conventional locks and instead use locks that respond only when a particular numeric or alphanumeric code is entered in a control panel.

In a residential environment, there is probably no easier way to gain admission to the interior of a residence than through sliding glass doors and sliding glass windows. The facility of gaining unauthorized entry to a home equipped with sliding glass doors and windows is due largely to the basic design of sliding glass doors and windows. Specifically, all that is usually necessary to remove a sliding door or window is to raise the door or window sufficiently to clear the side flanges of the lower track within which transverse sliding movement of the door or window occurs, and then merely remove the door or window out of the opening. Sliding glass doors that incorporate a transparent "slider" door portion that is mounted outside the transparent "fixed" portion of the door assembly are particularly vulnerable because of ready access to the "slider" door portion from outside the home.

Accordingly, one of the principal objects of the invention herein described and illustrated is the provision of a slidable deadbolt security device operable in cooperation with a horizontally sliding glass door or horizontally sliding glass window that enables the sliding glass door or window to be selectively conventionally locked in a closed position, or to be partially opened while being retained in its partially open position by preventing further opening and preventing lifting of the door or window from its track.

Another object of the invention is the provision of a slidable deadbolt security device for horizontally sliding glass doors and horizontally sliding glass windows that is inexpensive to manufacture, easy to install and manipulate into either a retracted door or window unlocked and openable condition, or a secured partially open door or window condition, and which is reliable in use.

A still further object of the invention is the provision of a slidable deadbolt security device for horizontally sliding glass doors and horizontally sliding glass windows that is interchangeable between the two, i.e., a single basic security device according to the invention may be used on either a horizontally slidable glass door or horizontally slidable glass window.

The invention possesses other objects and features of advantage, some of which, with the foregoing, will be apparent from the following description and the drawings. It is to be understood however that the invention is not limited to the embodiments illustrated and described, since it may be embodied in various forms within the scope of the appended claims.

SUMMARY OF THE INVENTION

In terms of broad inclusion, the slidable deadbolt security device of the invention comprises an elongated hollow metallic body or housing designed to be fastened to a base member or plate associated with a sliding glass door or sliding glass window. In the case of a sliding glass door the base member is securely mounted on the threshold or doorsill, while with a sliding glass window, the base member or plate is securely mounted on the windowsill. On a doorsill, the slidable deadbolt security device is fastened to the sill in association with the leading edge of the fixed door portion of the door assembly, so that the security device abuts the associated vertical edge of the fixed door portion. A spring-pressed deadbolt is slidably journaled on the housing and is manipulable to engage or disengage an aperture in the associated frame of the sliding door portion. The cooperative relationship of the slidable deadbolt, the aperture in the sliding door frame, and confronting elongated slots in the housing through which the deadbolt extends and along which the deadbolt is selectively slidable is such that the deadbolt cannot be released from its engagement with the sliding door frame unless the sliding door is first completely closed. Stated in other words, when the deadbolt is engaged in the sliding door frame and the sliding door is partially open, the sliding door must be moved to a completely closed position to enable disengagement, i.e., retraction of the deadbolt from the sliding door frame to thus enable total opening movement of the sliding door. The sliding glass door is thus restricted to slide only a predetermined distance correlated to the length of the slots in the housing when the deadbolt is engaged, thus preventing unauthorized entry, and also preventing the door from being lifted from its track. In another aspect of the invention, elating to sliding glass windows, the body or housing on which the deadbolt is slidably mounted is fastened to the windowsill in association with the leading edge of the fixed window portion of the window assembly remote from the window frame and spaced laterally from the fixed window frame to enable the slidable window portion to be disposed therebetween. An aperture in the frame of the sliding glass window, or in a flanged bracket attached to the trailing edge of the sliding glass window portion, receives the deadbolt, permitting the window to be partially opened a predetermined amount, but prevents further opening, prevents manipulation of the deadbolt to release its engagement with the window frame or flange, and prevents lifting of the slidable window from its track.

DESCRIPTION OF THE PREFERRED EMBODIMENTS

In terms of greater detail, the slidable deadbolt security device for sliding doors and windows is universally applicable to both interiorly and exteriorly installed sliding doors and sliding windows having either wood or metal frames, for the purpose of selectively enabling opening movment of a door or window for either a full-open distance or only a partially-open security distance.

Sliding doors, including glass doors, even those installed interiorly, have become notorious for the ease with which an intruder may gain entrance through such a door. In most instances, simply lifting the door from its threshold track enables removal of the entire door. Such lifting of the door is made possible because of the clearance that is usually provided between the top edge of the door and the door frame header to enable installation of the door. In many instances, this installation clearance may be eliminated after installation by insertion of appropriate spacers which, when installed, prevent lifting of the door. It is unfortunate that in many instances, the door installer fails to install such spacers, thus enhancing the risk of unauthorized intrusion.

Experience has taught that even where spacers are installed to thwart lifting of a sliding glass door, nevertheless, the door may still be forced open because the conventional latch mechanisms for such doors are notoriously ineffective to prevent unauthorized intrusion, often, all that is required to open the sliding glass door or window is to impose a force on the door in a direction to open it, with attendant forced release of the latch, thus enabling opening of the door without lifting it from its track. The sliding deadbolt security device of this invention at once prevents lifting of the sliding door or window from its running track, and limits movement of the sliding door or window by force applied thereto in a direction to open the door to no more than about four inches, even when the conventional latch has been released by force.

Figure 1:
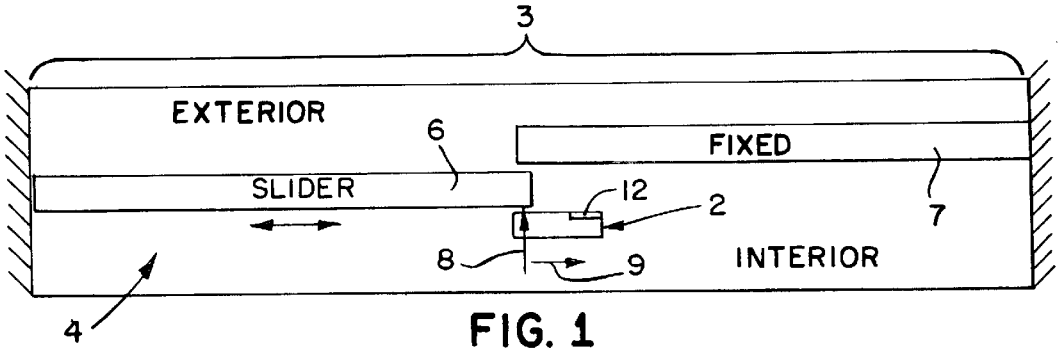
FIG 1 is a diagrammatic environmental view illustrating in plan an interior sliding door assembly having an interior sliding door portion that normally slides from a left closed position to a right full-open position, and illustrating the security device's parallel position in relation to the right edge portion of the interior sliding door and selectively manipulable to limit opening movement of the sliding door portion.
Figure 2:
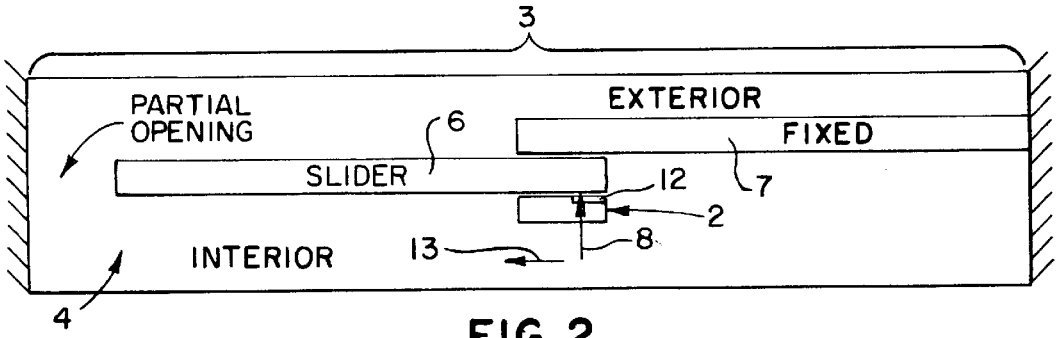
FIG. 2 is a diagrammatic environmental view similar to FIG. 1, but illustrating the interior sliding door partially open and retained in that condition by the security device against further opening.

Referring to FIGS. 1 and 2, there is illustrated diagrammatically the environmental arrangement of the security device of the invention designated generally by the numeral 2, installed with a sliding door assembly designated generally by the numeral 3 installed in a door opening having a threshold 4, wherein the slidable portion 6 of the sliding door assembly opens from left to right, and is mounted interiorly of the fixed portion 7 of the sliding door assembly which is shown mounted exteriorly in the door opening.

In the interest of clarity in the drawings, the conventional channels or tracks provided in the threshold or doorsill in sliding door assemblies have been omitted from the drawings. It should also be understood that the slidable deadbolt security device 2 is fixedly mounted on the threshold in a plane spaced laterally from the fixed door portion 7 associated with the overlapping edges of the fixed and slidable door portions and parallel thereto to enable the sliding door portion 6 to slide longitudinally along the threshold in a plane between the plane of the fixed door portion and the plane of the security device.

As shown diagrammatically in FIG. 1, the slidable deadbolt, here represented by the arrow 8, extends perpendicular to the long dimension of the security device 2, and when deployed, as will hereinafter be explained, engages the frame of the sliding door portion 6, and moves with the door portion to the right as indicated by arrow 9 when the sliding door is moved to the right with the deadbolt engaged.

As shown diagrammatically in FIG. 2, such movement to the right is limited to the altered position of the deadbolt as again represented by the arrow 8 when the deadbolt encounters and engages a notched integral abutment plate here represented diagrammatically by the rectangle 12. The notched integral abutment plate constitutes a flange integral with the security device 2 and is therefore also fixed to the threshold.

Accordingly, the slidable door portion 6, engaged by the slidable deadbolt 8, cannot be moved beyond the point where the slidable deadbolt abuts the abutment plate 12, nor can it be lifted out of its track or channel because it is engaged and retained in its track or channel by the slidable deadbolt engaged in the notch of the integral abutment plate. From the partially open position illustrated in FIG. 2 the only direction in which the slidable door portion 6 and engaged deadbolt may be moved is to the left as indicated by the arrow 13, to a closed position whereupon, if desired, the slidable deadbolt may selectively be retracted to then enable slidable movement of the door portion 6 to the right to a fully open position.

Figure 3:
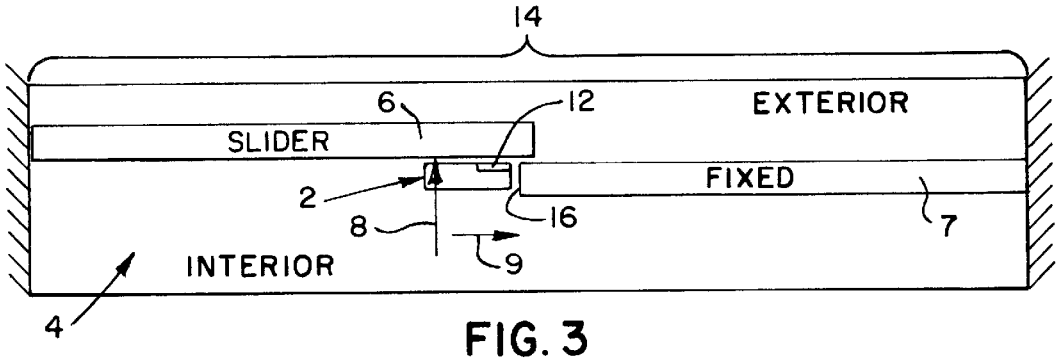
FIG. 3 is a diagrammatic environmental view similar to FIG. 1, illustrating in plan an exterior sliding door assembly in which the exterior sliding door portion slides from a left closed position to a right open position, and illustrating the placement of the security device in relation to the right edge portion of the exterior sliding door and the associated left edge of the fixed interior door portion of the sliding door assembly.
Figure 4:
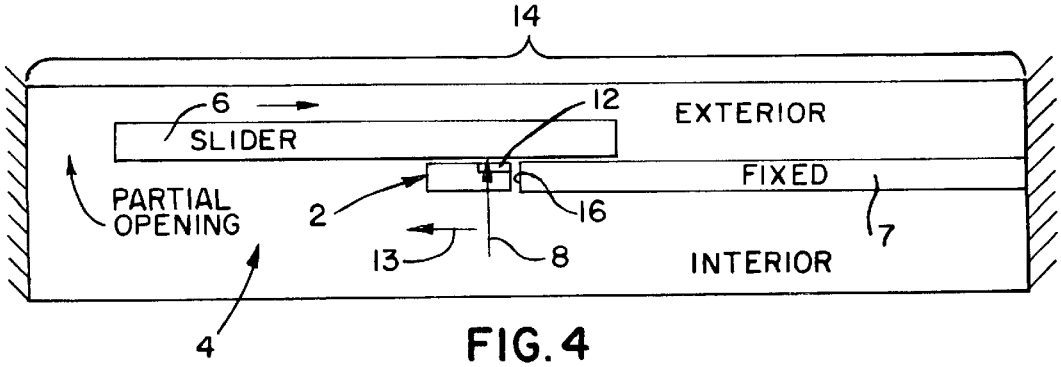
FIG. 4 is a diagrammatic environmental view similar to FIG. 3, but illustrating the exterior sliding door portion shifted to a partially open position and retained in this position by the security device against further opening.
Figure 5:
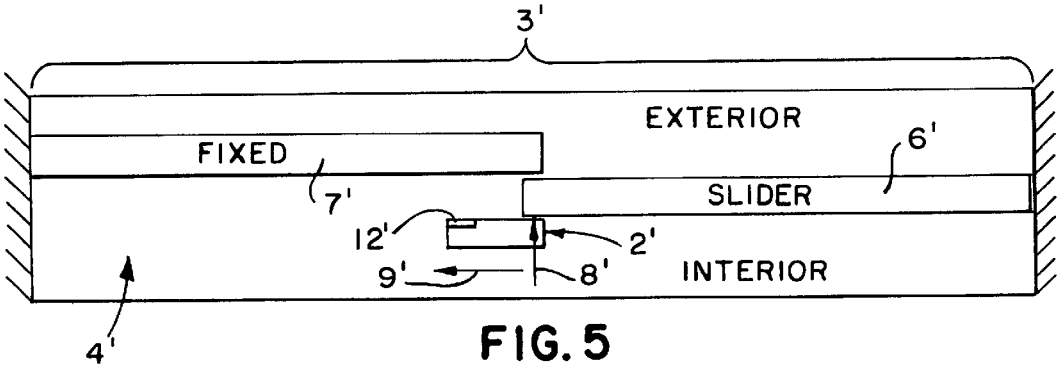
FIG. 5 is a diagrammatic environmental view illustrating in plan an interior sliding door assembly in which the interior sliding door portion slides from a right closed position to a left open position, and illustrating the security device's position in relation to the left edge portion of the interior sliding door.

Referring to FIGS. 3 and 4, there is illustrated a sliding door assembly designated generally by the numeral 14. Two significant differences are incorporated in these two views when compared with the sliding door assembly illustrated in FIGS. 1 and 2. Both differences are positional or orientational differences and accordingly the corresponding structural elements are identified in their new position or orientation by the same reference numbers. The first orientation difference is that in FIGS. 3 and 4, the slidable door portion 6 is mounted exteriorly of the fixed door portion 7, which in this arrangement has become the interior door portion as labeled in the drawings. Similarly to the slidable door portion 6 of FIGS. 1 and 2, the slidable door portion 6 of FIGS. 3 and 4 opens from left to right, but slides parallel to the exterior surface of the fixed portion 7.

One significance of this different orientation of the slidable door portion 6 in FIGS. 3 and 4 is that it renders the now exteriorly mounted door more accessible to removal, thus facilitating forced entry in a conventional sliding door assembly not equipped with the slidable deadbolt security device of the present invention.

The second significant difference, resulting as a consequence of the exterior orientation of the slidable door portion 6, is that the slidable deadbolt security device 2 must also be reoriented as shown in FIGS. 3 and 4. Thus, instead of being mounted on the threshold in a plane laterally spaced from and parallel to the fixed door portion 7, the security device 2 is now mounted in a plane that is coincident with the plane of the fixed door portion and laterally spaced and parallel to the plane of the slidable door portion 6. Stated in other words, the door portions 6 and 7 are mounted, respectively, in separate planes that are spaced and parallel to one another, while the slidable deadbolt security device 2 is in a plane coincident with the plane of the fixed door portion 7.

In this different orientation, the slidable deadbolt security device functions in the same manner and achieves the same result as previously described with reference to FIGS. 1 and 2. Thus, the slidable deadbolt, again represented by the arrow 8, extends transversely through the slotted housing of the security device and when deployed, engages an aperture in the lower frame member of the sliding door portion 6. As shown, the back end of the security device 2 abuts the front edge 16 of the fixed door portion 7 although for clarity in the drawings, the security device is shown spaced slightly therefrom.

As previously described with reference to FIGS. 1 and 2, the slidable door portion 6 as seen in FIG. 3, is in closed position. The deadbolt (represented by arrow 8) is shown adjacent the left end of the security device housing and when deployed, moves transversely through the slotted housing in the direction indicated by the arrow 8 and engages an aperture in the frame of door portion 6, as will hereinafter appear. Door portion 6 (FIG. 4) and the engaged slidable deadbolt have now been moved to the right to provide a partial opening as shown.

The width of the opening is limited by simultaneous abutment of the deadbolt against the end of the slot and against the slotted integral flange 12. When the deadbolt is in this limiting position, it cannot be retracted from its deployed condition of engagement with the frame of slidable door portion 6. The door portion 6 cannot be moved further to the right, nor can it be lifted from its track by virtue of engagement of the deadbolt with the notch of the integral flange 12. Thus, to retract the deployed deadbolt, the door portion must first be returned to a fully closed position as shown in FIG. 3. When retracted, the deadbolt is disengaged from the slidable door portion 6 and the door portion is free to slide to the right to a fully open position.

It will thus be seen that not only do the security device/door portion arrangements illustrated in FIGS. 1–4 limit opening of the slidable door portion to only about four inches, the placement of the security device adjacent the rear edge of the slidable door portion enables the width of the door portion 6 to prevent someone reaching the slidable deadbolt in an attempt to retract the deadbolt. But, as explained above, even if the security device could be reached, the deadbolt cannot be retracted as long as the slidable door portion is partially open.

The description above pertains to the sliding door assemblies depicted in FIGS. 1–4 wherein the sliding door portion in each door assembly opens from left to right when in either an interior orientation (FIGS. 1 and 2), or an exterior orientation as depicted in FIGS. 3 and 4.

Figure 6:
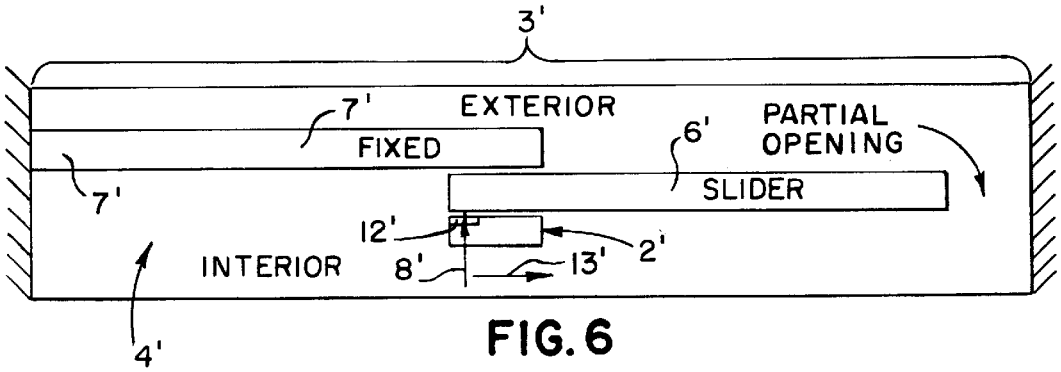
FIG. 6 is a diagrammatic environmental view similar to FIG. 5, but illustrating the interior sliding door partially open and selectively retained in that condition by the security device against further opening.
Figure 7:
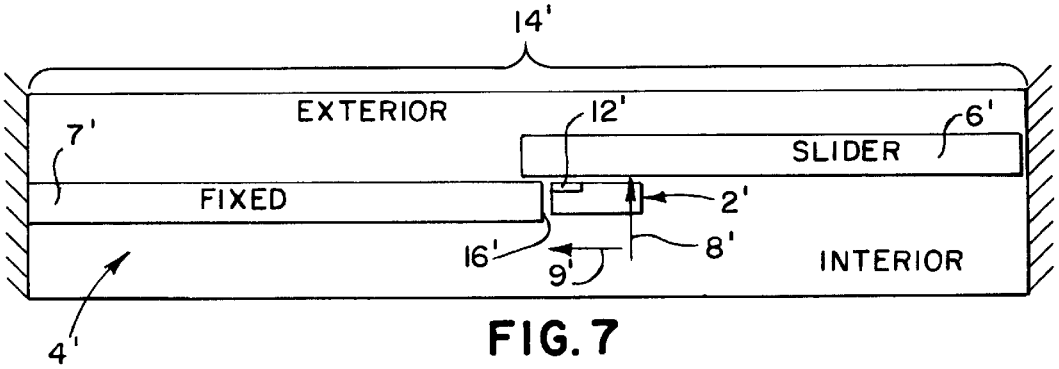
FIG. 7 is a diagrammatic environmental view similar to FIG. 1, illustrating in plan an exterior sliding door assembly in which the exterior sliding door portion slides from a right closed position to a left open position, and illustrating the security device's position in relation to the left edge portion of the exterior sliding door and the associated right edge of the fixed interior portion of the sliding door assembly.
Figure 8:
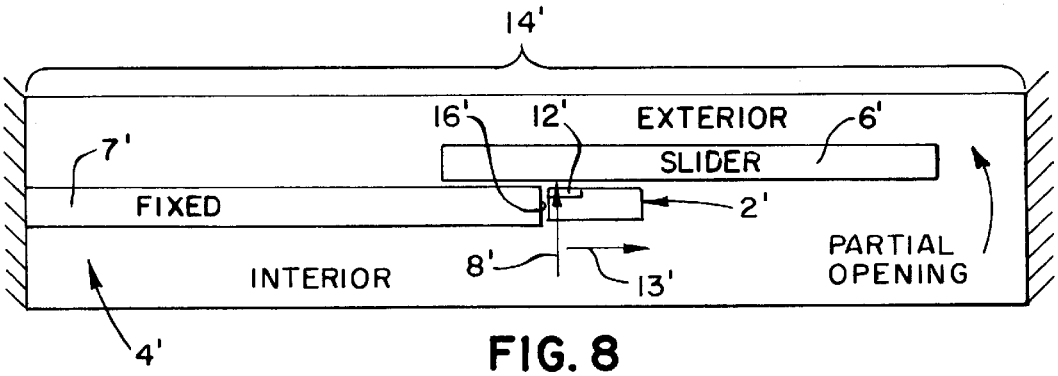
FIG. 8 is a diagrammatic environmental view similar to FIG. 7, but illustrating the exterior sliding door portion shifted to the left to a partially open position and retained in this position by the security device against further opening.

By contrast, referring to FIGS. 5–8, the sliding door assemblies there shown differentiate in a first respect from the FIGS. 1–4 door assemblies in that the slidable door portion 6' in each of these door assemblies opens from right to left. A second difference is that the slidable deadbolt security device 2' is designed to accommodate right to left slidability of the deadbolt represented by the arrow 8' when deployed to engage the slidable door portion 6' and the door portion is displaced to the left as depicted in FIGS. 6 and 8. This requires the notched abutment plate 12' to be adjacent the opposite end of the security device from where it is depicted in FIGS. 1–4 so that the notch in the abutment plate 12' opens to the right to receive the leftward moving deadbolt engaged to the leftward moving door portion. In the interest of brevity in this description, elements in this embodiment corresponding to elements in FIGS. 1–4 are indicated by corresponding primed reference numbers. In all respects, the sliding door assemblies depicted in FIGS. 5–8 accomplish the same purpose and function by the same mode as the sliding door assemblies illustrated in FIGS. 1–4.

Figure 9:
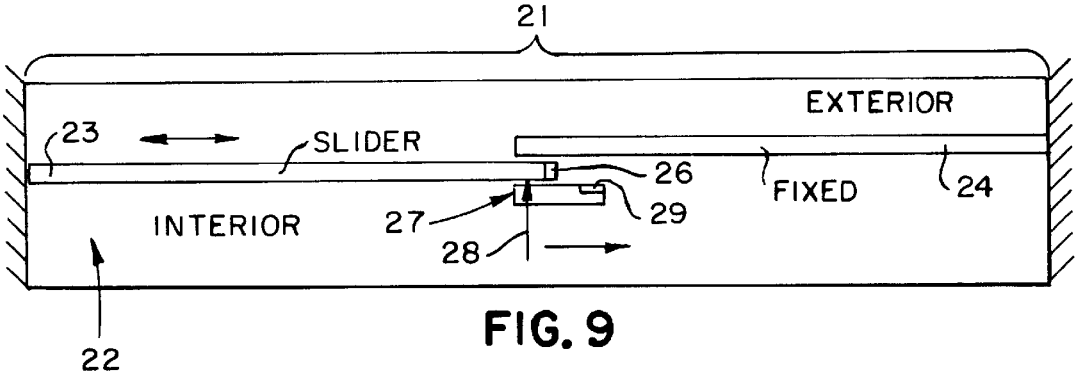
FIG. 9 is a diagrammatic environmental view in plan of a sliding window assembly in which the slidable window pane opens from left to right, and illustrating the position in which the security device is mounted in relation to the associated edges of the fixed and slidable window components of the assembly.
Figure 10:
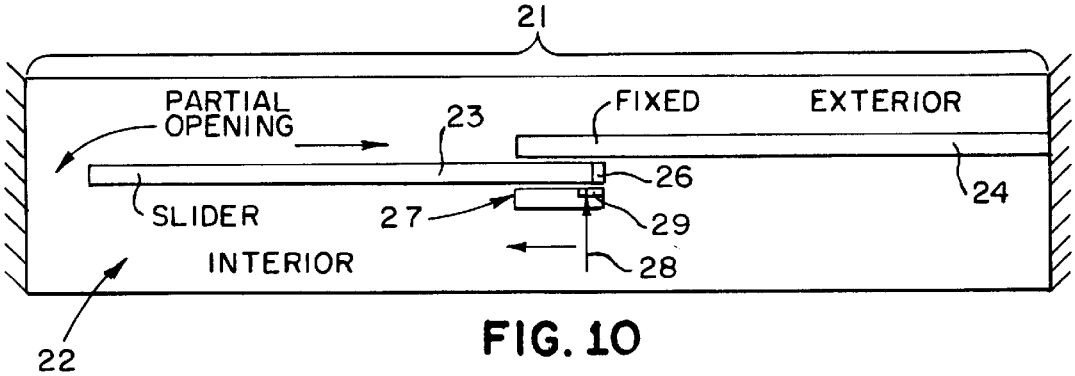
FIG. 10 is a diagrammatic environmental view similar to FIG. 9, but showing the slidable window partially open and held against further opening by the security device.

Referring to FIGS. 9–12, these environmental views illustrate diagrammatically the slidable deadbolt security device of the invention installed in sliding glass window assemblies. Unlike sliding glass door assemblies in which the slidable door portion may be installed interiorly or exteriorly as described above with reference to FIGS. 1–8, in sliding glass window assemblies the sliding glass pane appears always to be mounted interiorly. However, similarly to sliding door assemblies, the sliding glass pane, although mounted interiorly, may be mounted so that it opens either from left-to-right or right-to-left. Thus, in the drawings, FIGS. 9 and 10 illustrate a sliding window assembly in which the sliding glass pane opens from left-to-right, while in FIGS. 11 and 12, the sliding glass pane opens from right-to-left.

Referring to FIGS. 9 and 10, it will be seen that a sliding window assembly is depicted diagrammatically and designated generally by the numeral 21. The sliding window assembly is mounted on a windowsill 22 conventionally supported on structural framing (not shown). The window assembly includes a quadrilateral frame (not shown) that is of conventional extruded metal design having elongated window pane guide channels formed therein but not shown in the drawings in the interest of clarity. The window assembly also includes two parallel panes 23 and 24 of framed glass, the framed glass pane 23 being selectively slidable longitudinally along the window frame supported on the windowsill. The framed glass window frame 24 is fixed immovably to the window frame along three edges. The fourth leading-edge portion of the fixed pane lies adjacent to the rear edge portion of the slidable pane 23 in a juxtaposed parallel relationship.

Sliding glass windows are conventionally provided with a latch of some type that may be manipulated to lock and unlock the slidable window pane to the fixed window pane. Usually, the latch is mounted on the rear edge of the slidable window pane and may be manipulated to engage or disengage the associated and juxtaposed leading edge of the fixed window frame. In FIGS. 9 and 10, this type of a selectively lockable or unlockable latch is designated generally by the numeral 26. The detailed construction of the latch 26 is not illustrated since it forms no part of the invention described and claimed herein.

Figure 14:
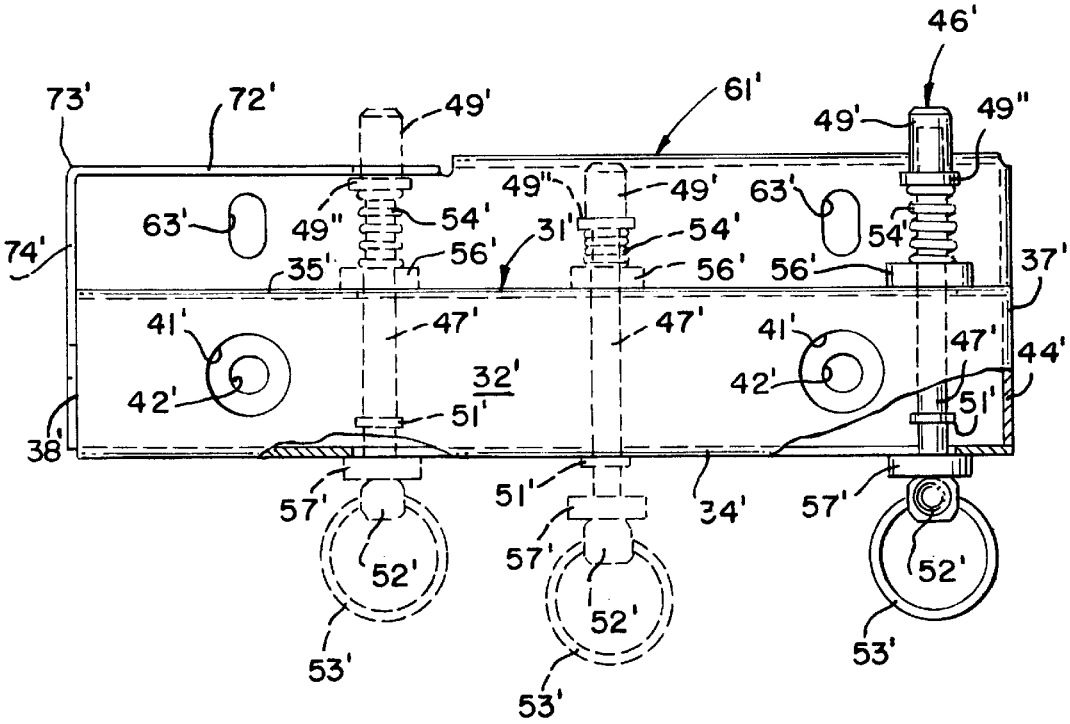
FIG. 14 is a plan view similar to FIG. 13 but showing an embodiment of the security device that accommodates installation with a sliding door assembly in which the sliding door portion of the assembly opens from right to left as shown in FIGS. 7 and 8 with the deadbolt shown in solid lines in a door-engaging position, and shown in broken lines in an intermediate fully retracted position, and in broken lines in a door-partially-open retention position.
Figure 15:
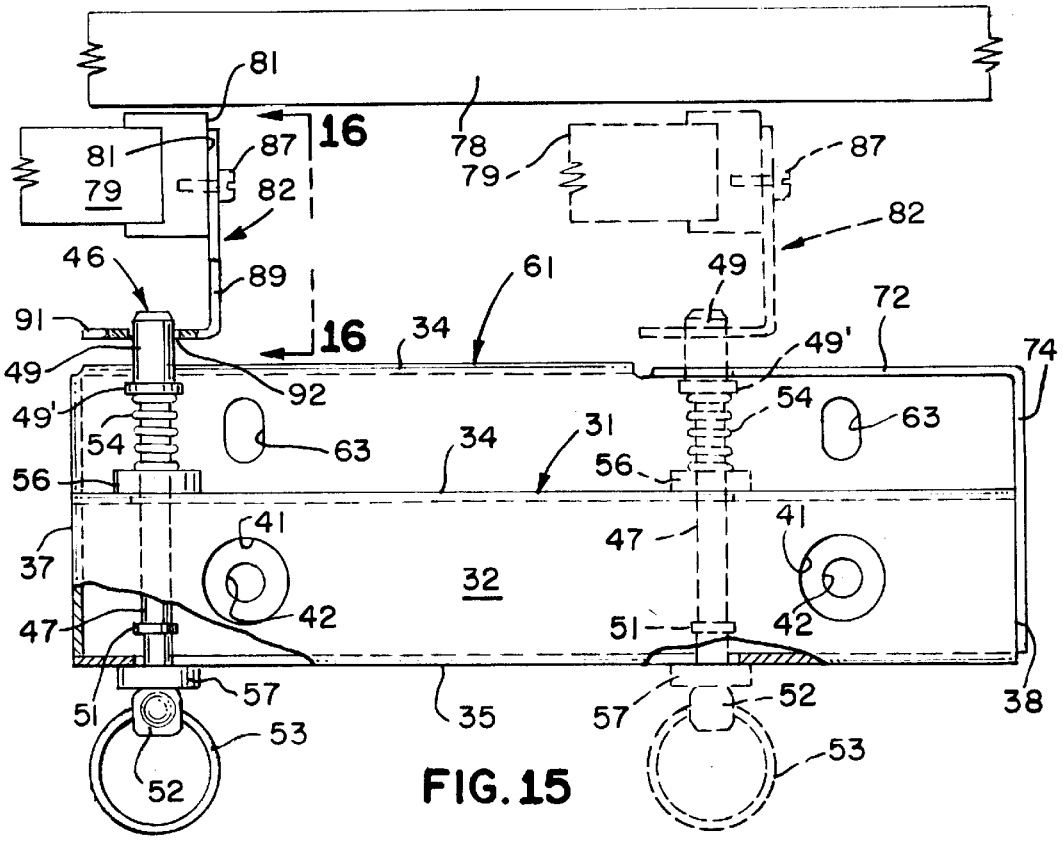
FIG. 15 is a plan view of the window security device for a left-to-right opening window as illustrated in FIGS. 9 and 10, showing a portion of the slidable window portion in window-closed position in full lines and engaged by the slidable deadbolt, and in broken lines showing the slidable window in partially open position and retained against further opening by the security device.
Figure 16:
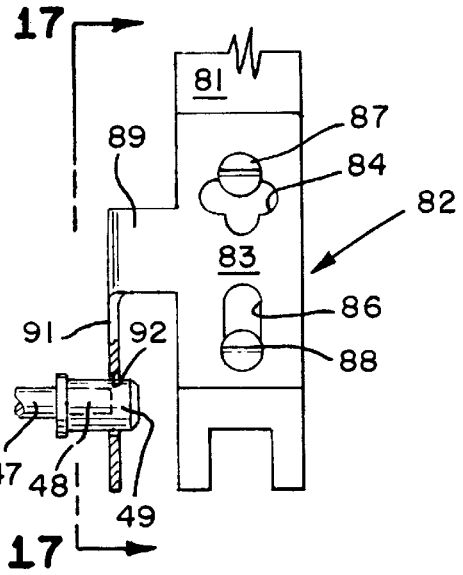
FIG. 16 is a fragmentary rear elevational view of the slidable window portion of FIG. 15 taken in the direction indicated by the arrow 16 in FIG. 15 and illustrating the metal bracket attached to the rear edge of the window engaged by the slidable deadbolt.
Figure 17:
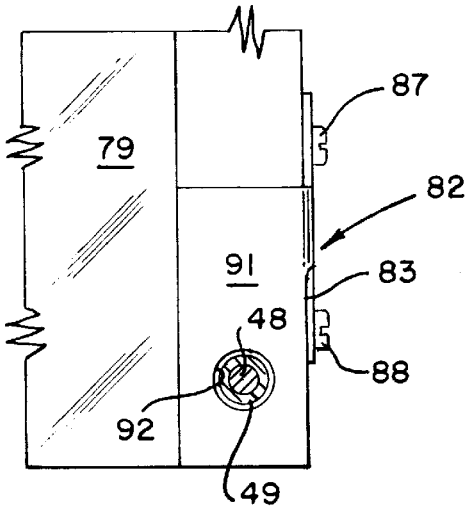
FIG. 17 is an elevational view of the bracket taken in the direction of the arrow 17 in FIG. 16.

Again referring to FIGS. 9 and 10, the elongated slidable deadbolt security device is illustrated and designated generally by the numeral 27 and is mounted fixedly on the windowsill 22 juxtaposed and parallel to the slidable pane 23, and laterally spaced from the fixed pane 24. The structure of the slidable deadbolt security device is similar to the slidable deadbolt security device illustrated in FIGS. 1–8, and the specific structure is described hereinafter with reference to FIGS. 13–21. The slidable deadbolt security device 27 includes a base member and a slotted housing and a slidable deadbolt here represented diagrammatically by the arrow 28. The slidable deadbolt extends perpendicularly through the slotted housing of the elongated security device and may be digitally manipulated into a deployed condition in which the deadbolt engages the frame of the slidable window pane or a bracket attached thereto as shown in FIGS. 15–17, or retracted to disengage the frame or frame bracket of the slidable window pane. When the latch 26 is unlocked and the security device deadbolt is retracted to disengage the window frame, the slidable window pane may be moved from left to right to a full open position without restriction.

However, with the latch unlocked to release the slidable window pane for movement, but with the slidable deadbolt deployed to engage the window frame, the slidable window pane may be moved from left to right but only for about four inches until the slidable deadbolt abuts the end of the slot in the housing body and the deadbolt head abuts the slotted integral abutment flange 29 projecting into the path of the slidable deadbolt as depicted in FIG. 10. The slidable window pane is thus restricted to this partial open condition, and because of the interrelationship of the slidable deadbolt and the slotted housing on which it is mounted and through which the deadbolt projects, the deadbolt cannot be retracted to disengage the window pane, thus effectively preventing further opening of the slidable glass window pane. Because of its placement juxtaposed to the rear edge of the window pane, it is not possible to reach the security device through the four inch partial opening between the front or leading edge of the framed glass pane and the window frame. But even if the security device could be reached, the slidable deadbolt cannot be retracted while the window pane is partially open as shown in FIG. 10. To effect retraction of the slidable deadbolt to release the window pane, the window pane must be moved to the left to a completely closed condition as shown in FIG. 9.

Figure 11:
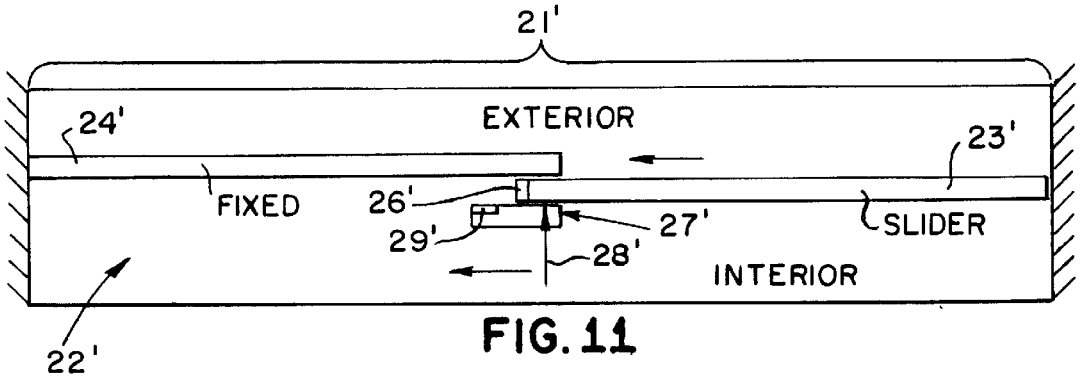
FIG. 11 is a diagrammatic environmental view similar to FIG. 9, but illustrating the sliding window arranged to open from right to left.
Figure 12:
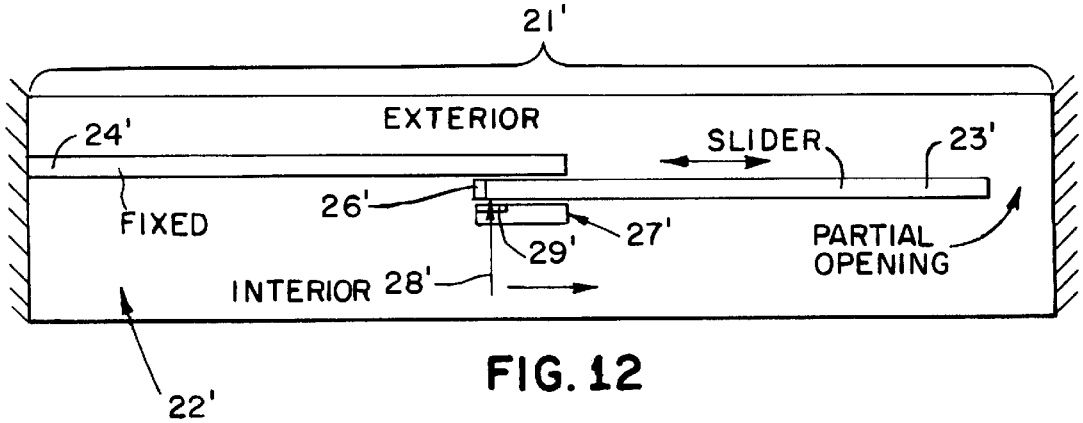
FIG. 12 is a diagrammatic environmental view in plan similar to FIG. 11, but showing the sliding window partially open and retained against further opening by the security device.

FIGS. 9 and 10 illustrate diagrammatically a sliding window assembly 21 in which the sliding window pane 23 opens from left to right. Contrastingly, in FIGS. 11 and 12, the sliding glass window assembly 23' includes corresponding elements designated by the same but primed reference numbers, and illustrates an assembly in which the slidable window pane slides from right to left. Essentially, there are only two differences in the structure of the security device to accommodate the right-to-left limited movement or partial opening of the slidable window pane. The first difference is that the abutment flange 29' is positioned at the opposite end of the security device as shown in FIGS. 11 and 12 so as to effectively interrupt leftward movement of the slidable deadbolt, thus limiting movement of the window pane to provide only a partial opening as shown in FIG. 12. Secondly, the interrelationship of the slidable deadbolt and the slotted housing are re-arranged as shown in FIG. 14 to enable retraction of the deadbolt from engagement with the window pane only when the window pane is fully closed by movement to the right as shown in FIG. 11. The significance of these differences will be more apparent from the illustrations in FIGS. 13–21 and the detailed description of these illustrations that follows.

Figure 13:
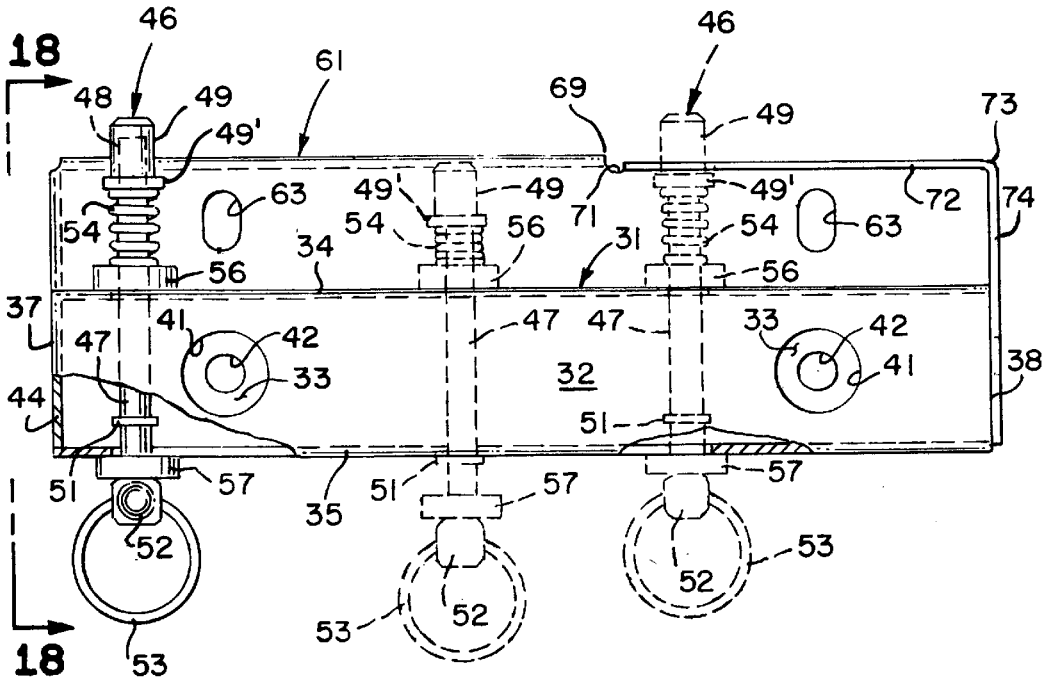
FIG. 13 is a plan view of the security device shown for installation on a sliding door assembly in which the slidable door portion opens from left to right as in FIGS. 3 and 4 and shown apart from a door assembly in the interest of clarity, and illustrating the sliding deadbolt of the device in three different positions.

Referring first to FIGS. 13, 18, 19, 20 and 21, there is illustrated the basic structure of the sliding deadbolt security device of the invention for installation on a sliding glass door assembly or a sliding glass window assembly. As seen in FIG. 13, the sliding deadbolt security device includes an elongated tubular metal body designated generally by the numeral 31. The body 31 is preferably rectangular in cross-section, being wider than it is high, to provide an upper wall 32, a lower wall 33, left and right side walls 34 and 35, respectively, each having an elongated slot 36 therein (FIG. 19) medianly formed in the associated side walls so as to confront one another in transverse alignment and length and extending from adjacent the closed front end 37 of the body 31 to adjacent the open rear end 38 of the body. Each slot 36 is uniform in a width of about ⅛' over its entire length, and each slot terminates spaced about ¼' from the front end 37 of the body, where the ends of the slots are enlarged into generally circular apertures 39 merging smoothly into the slots for a purpose which will hereinafter appear. The diameters of the enlarged circular slot-end apertures 39 are greater than the width of the slot by at least 1/16', and the apertures may be axially aligned with the longitudinal axis of the slots, or may be offset so that a corresponding edge of each slot merges smoothly with the corresponding peripheral edge of the associated slot.

Adjacent each end, the top wall 32 is provided with access apertures 41 positioned medianly between the side walls. In axial alignment with the access apertures, there are provided mounting holes 42 in the bottom wall 33 for reception of mounting screws 43 inserted through the access apertures and through the mounting holes 42 for attachment of the security device to the windowsill as will hereinafter be explained. The front end of the tubular body or housing 31 is closed by an integral closure plate 44 that constitutes an extension of the top wall 32 bent downwardly to close the end of the tubular body.

The foregoing describes the support housing or body 31 that supports the slidable deadbolt assembly designated generally by the numeral 46 in a manner to enable selective engagement or disengagement of the slidable deadbolt with an associated sliding glass door or window.

Referring to FIG. 13, it will there be seen that the slidable deadbolt assembly extends transversely through the slots 36 and is slidably supported on the housing 31 as previously described. The slidable deadbolt assembly comprises an elongated shaft designated generally by the numeral 47, the shaft at one end 48 being threaded to receive a generally cylindrical head 49 that is threaded onto the associated threaded end of the shaft and is adapted to selectively penetrate and engage an appropriately sized aperture (not shown) formed in the slidable glass door frame or slidable glass window frame. A radial flange 49' is formed at the base of the deadbolt 49 as shown. intermediate its opposite ends and spaced a predetermined distance from the end of the shaft remote from the threaded end 48, the shaft 47 is provided with a radial flange 51, smaller in diameter than the head 49, slightly larger in diameter than the major portion of the shaft 47, and slightly less in diameter than the circular slot enlargement 39. On the end of the shaft 47 remote from the threaded end 48 and the head 49, the shaft is provided with an enlarged generally spherical integral head portion 52. The spherical head portion 52 is bored diametrically to receive a pull ring 53 therethrough. The ring is sufficiently large in diameter to be grasped by a finger so as to impose a tensive force on the shaft 47.

Figure 18:
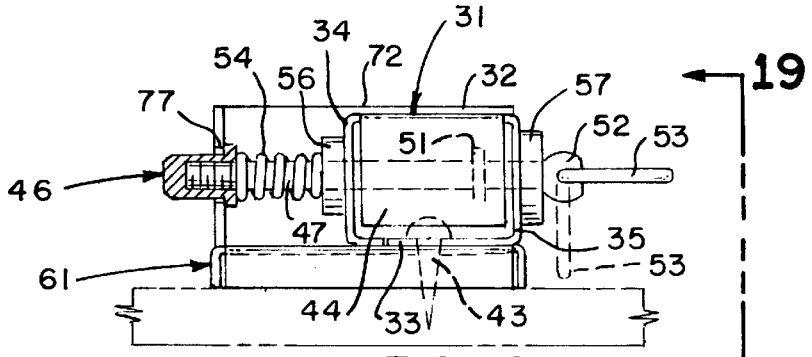
FIG. 18 is an end elevational view taken in the direction of the arrows on the line 18—18 in FIG. 13, and illustrating the manner of attachment of the sliding door security device to the door threshold shown in broken lines.
Figure 19:
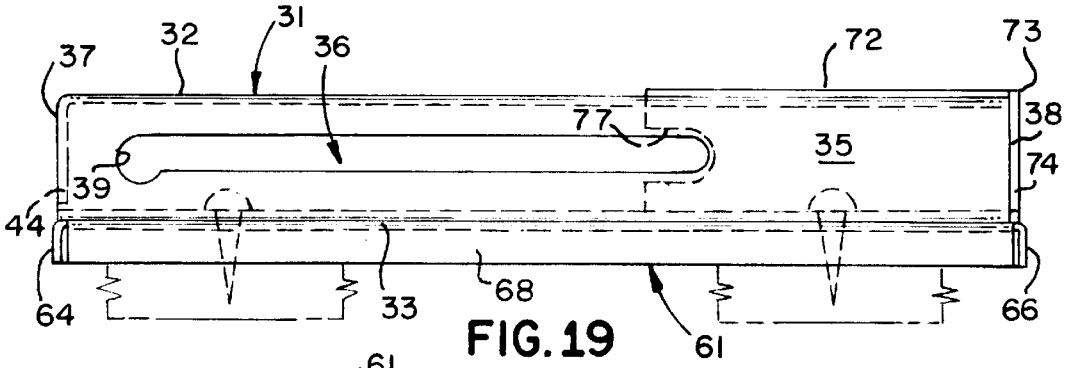
FIG. 19 is a side elevational view taken in the direction of the arrow 19 in FIG. 18. The slidable deadbolt has been removed in the interest of clarity.
Figure 20:
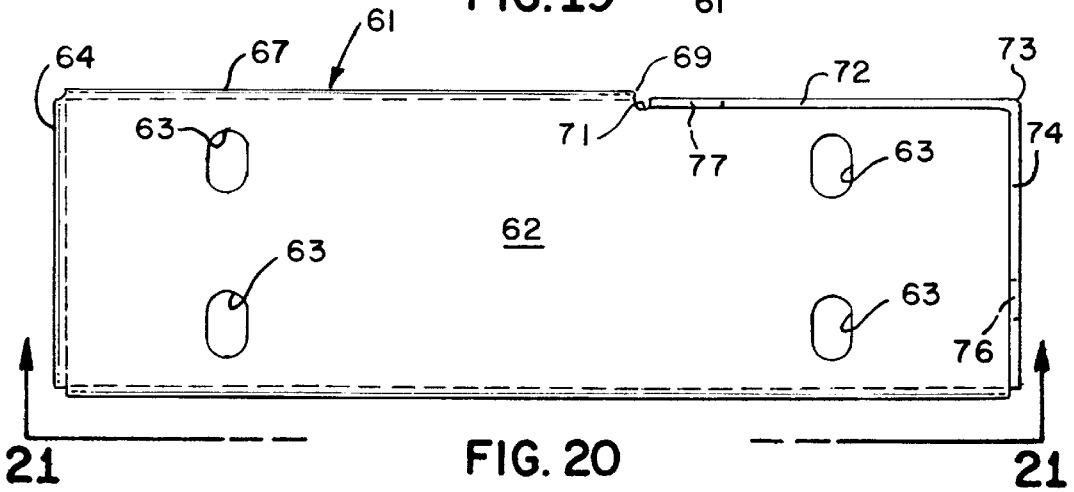
FIG. 20 is a top plan view of the base member of the sliding door security device shown apart from other structure.

As will be seen from FIGS. 13 and 18, a coil compression spring 54 is slipped over the shaft 47 and is interposed between the head 49 and the left side wall 34 of the body 31. Also mounted on the shaft 47, between the spring and the side wall 34, is a washer 56. A washer 57 is interposed between the spherical head 52 and right side wall 35, both washers having central apertures of sufficient diameter to slip over the intermediate radial flange 51.

Thus, when the slidable deadbolt assembly is mounted on body 31 as shown in FIGS. 13 and 18 in its deployed position at the left or front end of the security device, and the shaft 47 passes axially through the enlarged slot apertures 39, the slidable deadbolt may be retracted from its deployed position by inserting a finger in the pull ring 53 and pulling on the pull ring until the intermediate radial flange 51 is pulled through the enlarged circular aperture 39 formed at the associated end of the elongated slot 36 sufficiently to compress the spring 54 and place the radial flange 51 adjacent the outer surface of the right wall 35, whereupon longitudinal displacement of the slidable deadbolt to the right causes the radial flange 51 to span the slot 36, impinging on the side wall 35, and thus disengaging the head 49 from the aperture in the door frame, and thus permitting the slidable door to move to the right to its full open position without restriction. The slidable door may also be moved to a fully closed position without restriction. This fully retracted position of the slidable deadbolt to disengage the slidable door is shown in broken lines in an intermediate position in FIG. 13.

The tubular housing or body 31 that slidably supports the slidable deadbolt 46 must of course be secured to the door threshold. This is effected by providing a base member designated generally by the numeral 61 and supporting the tubular body 31 on the base member adjacent the right edge thereof as illustrated in FIGS. 13 and 18. The base member 61 is shown apart from other structure in FIGS. 20 and 21. As there shown, the base member comprises a main body portion 62 formed from flat sheetmetal and stamped to provide pairs of elongated mounting apertures 63 through which mounting screws 43 (FIG. 18) may extend to attach the base member to the doorsill or windowsill.

The base member is generally elongated and rectangular, and provided on its front, rear, left and right side peripheral edge portions with downturned flanges 64, 66, 67 and 68, respectively, to provide some depth to the base member, and to rigidify the base member. Along its left side, the flange 67 is interrupted at 69 by a relief recess 71, and there is provided an upwardly projecting abutment flange 72 integral with the main body portion, and extending from the corner 73 to the relief recess 71 in a forward direction, and having a perpendicular integral portion of flange 72 extending transversely across the rear end 66 of the base member, but unconnected thereto, to provide a mounting flange 74 having an aperture 76 therein through which a mounting screw (not shown) may be driven into the associated front edge of the fixed door portion of a sliding door assembly as illustrated in FIGS. 3 and 4.

Figure 21:
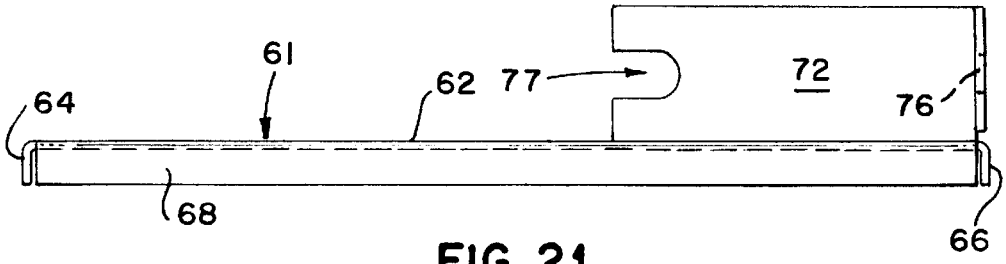
FIG. 21 is a side elevational view of the base member of FIG. 20, shown apart from other structure, and taken in the direction of the arrows on line 21—21 in FIG. 20.

As seen best in FIGS. 18 and 21, the abutment flange 72 is provided with a forwardly opening slot or notch 77 having a width sufficient to easily receive the diameter of the slidable deadbolt head 49 when the slidable deadbolt is transferred all the way to the right as illustrated in FIG. 13 in broken lines. It will be remembered that in this position of the deadbolt it is engaged with the slidable door portion of the door assembly and restricts movement of the door in an opening direction to no more than about four inches. It will also be remembered that in this deployed position, the radial flange 51 is inside the tubular member as shown, and because it is larger in diameter than the width of the slot 36, the slidable deadbolt cannot be retracted to disengage the door or window because the radial flange will impinge against the inner surface of the right wall 35 and prevent extraction of the deadbolt head 49 from the aperture in the door or window frame in which it is embedded.

Referring to FIG. 14, the embodiment of the invention there shown illustrates the arrangement of the base member and elongated tubular body, including the slidable deadbolt supported thereon, for use in connection with a sliding door or sliding window pane that slides from right-to-left as indicated diagrammatically in FIGS. 5–8 and FIGS. 11 and 12. The description heretofore provided of these relationships is included hereat by reference in the interest of brevity in this description. Additionally, again in the interest of brevity, corresponding elements illustrated and described in FIG. 13 are similarly indicated in FIG. 14 by corresponding primed reference numbers.

It should be noted that in this embodiment or re-arrangement of the elements of the security device, the abutment flange 72' is positioned at the left end of the base member as shown in FIG. 14 instead of at the right end as shown in FIG. 13, so as to intercept a leftward moving deadbolt engaged in a leftward moving door portion or window pane. In the same vein, the slidable deadbolt is positioned at the extreme right end of the assembly when in deployed condition to engage a sliding door or sliding window pane, and is restricted in its leftward movement by the abutment flange 72' as shown in broken lines in FIG. 14 and by the associated end of the slot. The retracted condition of the slidable deadbolt is illustrated in an intermediate position in broken lines, similarly as shown in FIG. 13. In all respects, the function and mode of operation of the two embodiments illustrated in FIGS. 13 and 14 are identical except for the direction in which the slidable deadbolt and engaged slidable door or slidable window pane move from a completely closed condition to a partially open condition.

It has been found that in some types of sliding glass windows, the metal frame within which the glass pane is retained is not of sufficient height to enable boring an aperture in the metal frame to receive the head 49 of the slidable deadbolt as described above.

To obviate this problem, reference is made to FIGS. 15, 16 and 17, wherein there is partially illustrated diagrammatically in FIG. 15 a sliding window assembly including a fixed framed window pane 78 lying in a plane spaced and parallel to a slidable window pane 79, arranged in juxtaposed parallelism as previously described with reference to FIGS. 9 and 10. Operatively associated with, and laterally spaced from the associated back edge 81 of the slidable window pane 79, is mounted a slidable deadbolt security device in all respects similar to the security device illustrated in FIG. 13. Accordingly, corresponding elements have been indicated by corresponding reference numbers in the two views.

It should be noted that the slidable deadbolt security device in FIG. 15 is spaced laterally from the associated back edge of the window pane a greater distance than is the case when the head 49 of the deadbolt is able to directly penetrate an aperture formed in the associated edge portion of a sliding door or sliding window pane. In this instance, the gap between the deadbolt head 49 and the rear edge 81 of the sliding window pane is bridged by a metal bracket designated generally by the numeral 82.

The bracket is farmed with a flat main body portion 83 adapted to lie flat against the rear edge 81 of the framed window pane as shown in FIG. 15. Two mounting apertures 84 and 86 are provided as shown, the aperture 84 being "cruciform" in configuration to accommodate lateral and vertical adjustment of the bracket in relation to a mounting screw 87, while the aperture 86 is elongated to accommodate vertical adjustment of the bracket on the rear edge 81 of the associated framed window pane. A second mounting screw 88 penetrates the aperture 86 and is threaded into the metal frame surrounding the glass window pane as shown to retain the bracket 82 fixedly attached to the framed window pane.

A gusset 89 integral medianly with the main body portion 83 of the bracket 82 projects laterally away from the main body portion of the bracket in the same plane and at its end remote from the bracket is integral medianly with an elongated flange 91 that lies in a plane perpendicular to the plane of the main body portion 82 of the bracket. Formed in the lower end portion of the flange 91 below the gusset 89 is an aperture 92 sized to readily receive the slidable deadbolt head 49 when the slidable deadbolt is deployed, as shown in FIGS. 15 and 16, to engage the window frame by virtue of engagement with the bracket 82. It will thus be readily apparent that when the latch of the slidable window pane is unlatched and the window pane is moved to the right as shown by broken lines in FIG. 15, the deployed slidable deadbolt will be moved with the window to the right until the head 49 of the deadbolt penetrates the notch 77 in the abutment flange 72 and is intercepted by the abutment flange and prevented from moving further to the right. This intercepted position of the slidable deadbolt is illustrated in broken lines in FIG. 15.

From the foregoing it will be seen that the elongated metallic base member 61 (FIGS. 20 and 21), the elongated tubular metallic body 31 (FIGS. 13, 18 and 19), the slidable deadbolt assembly 46 (FIGS. 13, 15 and 18), and the bracket 82 constitute the major elements of the combination which, when assembled and secured to a door threshold or a windowsill in association with a sliding door or sliding window, respectively, comprises the slidable deadbolt security device of the invention. It should be understood that the elongated metallic base member 61, the elongated tubular metallic body 31, the separate elements that make up the slidable deadbolt assembly 46, and the bracket 82 are all separately manufactured items that may be packaged for sale individually, partly assembled, or totally disassembled for assembly and installation by the purchaser. It should also be understood that a sheet of instructions correlated to suitable graphic illustrations depicting proper installation steps, are included in each package.

Regarding assembly of the slidable deadbolt security device from a package that contains all of the parts suitable for installation with a slidable door assembly in which the slidable door portion opens from left to right, reference is made to FIGS. 13, 15 and 18. First, the disassembled parts of the slidable deadbolt assembly are conveniently arranged in the order of installation. The pull ring 53 is mounted on the spherical head 52, the washer 57, preferably formed from a suitable synthetic resinous material such as that sold under the trademark "Teflon", is slipped over the shaft 47 so that it abuts the spherical head 52, next the shaft 47 is inserted through the aperture 39 in the elongated body 31 until the washer 57 abuts the side wall 35, then the washer 56 is slipped over the threaded end of the shaft and pushed against the side wall 34. The spring 54 is then slipped over the threaded end of the shaft until it abuts the washer 56, and lastly, the slidable deadbolt head 49 is threaded onto the threaded end 48 of the shaft 47. At this point in the assembly of the security device, the pull ring should be pulled to make sure that the flange 51 can be pulled through the aperture 39 and the slidable deadbolt assembly slid along the slot 36 with the flange 51 abutting the outside surface of the wall 35. This is the completely retracted condition of the slidable deadbolt as shown in the intermediate position in FIGS. 13 and 14. In this retracted position, it is preferable that the spring 54 be essentially completely compressed between the washer 56 and the deadbolt head 49 as shown in the intermediate positions of the deadbolt illustrated in FIGS. 13 and 14.

Satisfied that the slidable deadbolt assembly is properly mounted in the slots formed in the elongated tubular metallic body or housing, the slidable deadbolt is returned to axial alignment with the confronting apertures 39. The tubular body, with slidable deadbolt mounted thereon, is now superimposed on the base member 61 in the manner illustrated in FIGS. 13 and 15. This assembly is then placed on the surface of the doorsill or threshold adjacent the rear edge of the completely closed sliding door, generally in the positions illustrated diagrammatically in FIGS. 1, 3, 5 and 7 of the drawings.

While holding the security device stationary on the threshold, the adjacent surface of the slidable door where the deadbolt head 49 impinges against the door frame is marked in whatever manner is most convenient to indicate the location where a hole having a diameter of about ⅜" must be drilled in the door frame to receive the deadbolt head 49. Following marking, the security device is removed from the threshold and the hole is drilled. Thereafter, the security device is reapplied on the surface of the threshold so that the deployed head 49 of the deadbolt readily penetrates into the hole bored into the door frame, or into a bushing that might be pressed into the hole to receive the deadbolt head.

While the security device is thus held stationary on the threshold in a selected position with the deadbolt engaged with the sliding door, the pull ring is grasped and pulled to retract the deadbolt to insure that when retracted it will not interfere with sliding movement of the door. Ideally, when retracted, the extreme end surface of the deadbolt head 49 should be flush with the associated edge of the base member as shown in the retracted position of the deadbolt in FIGS. l3 and 14. When it is certain that the base member is in proper position, a suitably sized center punch, not shown, is dropped axially through the access holes 41 and through the mounting holes 42 and the threshold surface is marked with the center punch to mark the location where mounting holes need be drilled into the threshold. It will of course be understood that instead of marking the threshold with a center punch, the holes may be drilled directly by extending a drill bit, properly sized, through the access holes 41 and the mounting holes 42 and drilling mounting holes directly into the threshold while the security device is temporarily held in place.

Lastly, with the security device supported on the surface of the threshold in proper position, self-tapping type screws 43 are inserted through the access holes 41 and the mounting holes 42 in the elongated tubular body, and through the mounting holes 63 in the base member that are axially aligned with the access and mounting holes 41 and 42, respectively, and the mounting screws are turned into the axially aligned bores drilled into the threshold. The installation is thus complete, and the slidable deadbolt security device may then be tested to insure that it will properly be intercepted by the abutment flange 72 when the door is opened with the deadbolt in deployed condition. Additionally, with the door returned to a completely closed condition, the slidable deadbolt should be retracted and displaced longitudinally of the slots 36 and then released to insure that the slidable door will move freely without interference from the slidable deadbolt in retracted position.

With regard to the intallation of the slidable deadbolt security device in operative association with a sliding glass window assembly, reference is made to FIGS. 9–17. As seen in FIG. 15, the slidable deadbolt security device in assembled form but unattached to the windowsill is placed on the windowsill generally in juxtaposed parallel association adjacent the rear end edge portion of the slidable window portion as clearly illustrated diagrammatically in FIGS. 9–12. With the security device held securely on the windowsill, the bracket 82 is applied to the rear edge of the framed window pane in a position so that the aperture 92 in the flange 91 is engaged by the head 49 of the slidable deadbolt. The rear edge of the framed window pane is then marked through the apertures 84 and 86, and the windowsill is marked through the access apertures 41 and mounting holes 42 as previously described. Appropriate bores are then drilled in the window sill and in the rear edge of the framed window pane and appropriate self-tapping screws such as 87 and 88 are appled to retain the bracket, while mounting screws 43 are turned into the windowsill through the mounting holes 42. With the slidable deadbolt security device thus mounted, clearances are tested for proper operation by deploying the slidable deadbolt and sliding the window to its partially open position, where the notched abutment flange 72 intercepts the slidable deadbolt engaged with the slidable window and restricts further movement. After sliding the window back to its fully closed position, the slidable deadbolt is retracted and displaced slightly along the slot 36 so that it will be retained in a retracted position by the side wail 35 of the elongated tubular body 31 and the window is then moved freely from full closed to full open position and back to fully closed position to insure that the security device does not interfere with the intentional full opening movement of the slidable window pane. If some interference is found, the screws 87 and 88 that secure the position of the bracket 82 may be loosened sufficiently to adjust the position of the bracket to eliminate any interference.

Having thus described the sliding deadbolt security device of my invention for use in connection with sliding glass door assemblies and sliding glass window assemblies, what is believed to be new and novel and sought to be covered by Letters Patent of the United States is as follows.

I claim:

1. A slidable deadbolt security device for installation in association with horizontally slidable door assemblies and horizontally slidable window assemblies, said slidable deadbolt security device comprising:

a) an elongated body having first, second, top and bottom sides and front and back ends, said elongated body having at least one slot that penetrates said first and second sides and extends longitudinally of said body from adjacent said front end to adjacent said back end; and b) a slidable deadbolt assembly mounted in said at least one elongated slot and digitally deployable or retractible to selectively engage or disengage, respectively, an associated slidable door or window to limit to at most the length of said slot the degree to which said slidable door or slidable window may be partially opened and which precludes lifting of said slidable door or slidable window when said slidable deadbolt is in engaged condition, while enabling unrestricted slidability of said associated door or window when said slidable deadbolt is in disengaged retracted condition.

2. The slidable deadbolt security device according to claim 1, wherein said deadbolt assembly extends transversely through said slot generally perpendicular to the elongated dimension of said elongated body.

3. The slidable deadbolt security device according to claim 1, wherein said elongated body is tubular with confronting first and second side walls, said at least one slot comprises confronting slots in said first and second side walls, and said deadbolt assembly extends transversely through the confronting slots in said first and second side wall generally perpendicular to the elongated body for selective lateral movement along said slots.

4. The slidable deadbolt security device according to claim 1, wherein means in addition to said at least one slot are operatively associated with said elongated body for intercepting and limiting lateral movement of said deployed slidable deadbolt assembly and the slidable door or slidable window to which it is engaged along said at least one slot.

5. The slidable deadbolt security device according to claim 1, wherein means are provided associated with said elongated body and interposed in the path of movement of said slidable deadbolt assembly when deployed to intercept said slidable deadbolt assembly to limit movement thereof in the direction of said means.

6. The slidable deadbolt security device according to claim 1, wherein said at least one slot at its end adjacent said front end of said elongated body is enlarged to provide a generally circular recess having a diameter greater than the width of said at least one slot.

7. The slidable deadbolt security device according to claim 1, wherein said top side of said elongated body is provided with access apertures adjacent said front and back ends, and said bottom side is provided with mounting apertures axially aligned with said access apertures and communicating therewith, and mounting screws penetrating said mounting apertures for securement of said elongated body to an associated threshold or windowsill.

8. The slidable deadbolt security device according to claim 1, wherein said at least one elongated slot is uniform in its width a communicates at its end adjacent said front end of said elongated body with an aperture having a diameter greater than the width of said slot and through which aperture said slidable deadbolt assembly projects transversely past said first and second sides of said elongated body.

9. The slidable deadbolt security device according to claim 3, wherein said confronting slots at their corresponding ends adjacent said front end of said elongated body are enlarged to provide axially aligned apertures having diameters greater than the width of said slots.

10. The slidable deadbolt security device according to claim 3, wherein said slidable deadbolt assembly includes an elongated shaft having an integral pull head at one end, a threaded end portion at its opposite end, a deadbolt head threaded onto the threaded end portion of said shaft, an intermediate integral radial flange spaced adjacent said pull head and having a diametric dimension in relation to said shaft greater than the width of said slot, spring means interposed between said deadbolt head and said first side of said elongated body and normally biasing said deadbolt assembly in a direction to engage an associated sliding door or sliding window, whereby said spring-pressed deadbolt assembly may be selectively laterally translated longitudinally of said body along said slot within the limits imposed by the length of the slot.

11. The slidable deadbolt security device according to claim 10, wherein said first and second confronting side walls are parallel, said elongated slots in said confronting first and second side walls are of uniform width, each slot terminating adjacent opposite ends of said elongated body and adjacent the front end of said body terminating in an enlarged aperture having a diameter sufficient to enable the passage of said radial flange therethrough, said deadbolt extends transversely through the slots in said side walls generally perpendicular to the elongated body, whereby said spring means normally resiliently biases said deadbolt head in a direction to engage an associated sliding door or sliding glass window and in said engaged position said intermediate radial flange on the elongated shaft is positioned within the tubular elongated body adjacent said second side wall and said deadbolt assembly may selectively be translated along the slots by opening and closing forces imposed on said sliding door or sliding glass window while remaining engaged thereto.

12. The slidable deadbolt security device according to claim 11, wherein said elongated shaft when extending through said enlarged apertures in said slots may selectively be translated perpendicular to the elongated body to compress said spring means and shift the radial flange through one of said enlarged apertures from the inside of said elongated body to the outside thereof, whereupon said deadbolt assembly is disengaged from said associated sliding door or sliding glass window and may selectively be translated along said slots to retain the sliding deadbolt assembly in a retracted condition.

13. The slidable deadbolt security device according to claim 4, wherein an elongated base member is adapted to be secured to a supporting surface such as a threshold or windowsill, and said elongated body is mounted on said base member.

14. The slidable deadbolt security device according to claim 13, wherein said means in addition to said at least one slot for intercepting and limiting lateral movement of said deployed slidable deadbolt assembly comprises a notched integral flange on said elongated base member.

15. The slidable deadbolt security device according to claim 14, wherein said base member comprises a flat metallic plate having integral peripheral flanges of equal height projecting therefrom, and said notched integral flange that intercepts said deadbolt projects in a direction opposite to said integral peripheral flanges.

16. The slidable deadbolt security device according to claim 15, wherein an apertured mounting flange is provided on said base member integral with said notched integral flange and extending perpendicular thereto transversely across the back end of said elongated body.

17. The slidable deadbolt security device according to claim 7, in which an elongated base member is disposed below said elongated body, a notched abutment flange integral with said base member projects parallel to said elongated body adjacent the rear end thereof, and mounting apertures are provided in said base member axialy aligned with said access apertures and said mounting apertures in said elongated body whereby said mounting screws penetrate the mounting apertures in said base member to secure said elongated body superimposed on said base member to an associatee threshold or windowsill.

18. In combination, a slidable window assembly including a fixed window pane and a horizontally slidable window pane having a rear edge arranged in juxtaposed parallelism to said fixed window pane and normally slidable in relation thereto, said slidable window pane having an apertured bracket attached to said rear edge; and a slidable deadbolt assembly operatively associated adjacent the rear edge of said slidable window pane and including a slidable deadbolt selectively deployable to engage the aperture in said bracket, said slidable deadbolt when engaged with said bracket being slidable with said bracket and window to restrict the degree of movement of said slidable window pane between completely closed and partially open conditions and retractable to disengage said apertured bracket to enable unrestricted movement of said slidable window pane and bracket.

19. As an article of manufacture:

a) an elongated body having first, second, top and bottom sides and front and back ends, at least one elongated slot that penetrates said first and second sides and is spaced generally medianly between said top and bottom sides and extends longitudinally of said body from adjacent said front end to adjacent said back end, said at least one elongated slot at its end adjacent said front end being enlarged to provide a generally circular aperture having a diameter greater than the width of said at least one elongated slot; and b) a slidable deadbolt assembly mounted in said at least one elongated slot in said enlarged circular aperture associated with the front end of said elongated body, said slidable deadbolt assembly comprising an elongated shaft having a pull head at one end, a deadbolt head at the opposite end, an intermediate integral radial flange spaced a predetermined distance from said pull head and having a diameter greater than the width of said slot but smaller than the diameter of said enlarged circular aperture, spring means interposed between said deadbolt head and said first side of said elongated body and normally resiliently biasing said deadbolt head away from said first side, whereby said slidable deadbolt assembly may be selectively translated to compress said spring means and to position said integral radial flange so that it resiliently impinges on the second side of said elongated body and said deadbolt head is retracted toward said first side of said elongated body and enabling said retracted slidable deadbolt assembly to move longitudinally along said at least one slot.

* * * * *